US008007145B2

(12) United States Patent
Leen

(10) Patent No.: US 8,007,145 B2
(45) Date of Patent: Aug. 30, 2011

(54) WORKLIGHT WITH A HANDS-FREE MOUNTING SYSTEM

(76) Inventor: Monte A. Leen, Bellevue, WA (US)

( * ) Notice: Subject to any disclaimer, the term of this patent is extended or adjusted under 35 U.S.C. 154(b) by 350 days.

(21) Appl. No.: 12/402,381

(22) Filed: Mar. 11, 2009

(65) Prior Publication Data

US 2010/0149824 A1 Jun. 17, 2010

Related U.S. Application Data

(60) Provisional application No. 61/121,801, filed on Dec. 11, 2008.

(51) Int. Cl.
*F21S 8/08* (2006.01)

(52) U.S. Cl. ..... 362/413; 362/427; 362/288; 362/289

(58) Field of Classification Search ..... 362/285, 362/287, 288, 289, 190, 191, 413, 418, 427, 362/430, 382
See application file for complete search history.

(56) References Cited

U.S. PATENT DOCUMENTS 4,885,667 A * 12/1989 Selden ..... 362/253
5,205,645 A * 4/1993 Lee ..... 362/431
6,213,626 B1 * 4/2001 Qian ..... 362/413
6,224,242 B1 * 5/2001 Giraud et al. ..... 362/287
6,354,720 B2 * 3/2002 Grossman et al. ..... 362/427

* cited by examiner

*Primary Examiner* — Bao Q Truong

(74) *Attorney, Agent, or Firm* — Dean A. Craine

(57) ABSTRACT

A worklight with head mounted on a stand that uses a hands-free mounting system that enables the lamp head to be tilted in different fixed angles without manually loosening and tightening knobs and nuts. The mounting system includes at least one nut body mounted or attached on the surface of the lamp head. The nut body includes a central post with a threaded bore surrounded by a plurality of radially aligned beveled ribs. The ribs are aligned parallel to the nut's longitudinally axis and are equally spaced apart thereby forming a plurality of slots surrounding the post. The post is slightly shorter than the surrounding ribs. The slots on one side of the nut body are aligned with slots located on the opposite side of the nut body. The stand includes at least one support arm with a straight portion. The outside surface of the straight portion has a diameter sufficient so that the inside surface of the straight portion rests in the two slots located on opposite sides of the nut body. The outer edges of the support arm are pressed inside by springs against the outer surfaces of the ribs.

3 Claims, 5 Drawing Sheets

WORKLIGHT WITH A HANDS-FREE MOUNTING SYSTEM

This is a utility patent application which claims benefit of U.S. Provisional Application No. 61/121,801, filed on Dec. 11, 2008.

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to a worklight with a lamp head mounted on stands or poles and more particularly to worklights that include an adjustable mounting apparatus between the lamp head and the pole or stand that enables the head lamp to be selectively aimed or moved to different fixed positions.

2. Description of the Related Art

Portable worklights commonly include lamp heads that are mounted on stands or poles that can be selectively aimed at different positions. Typically, the lamp head is supported by brackets that connect to the stand or pole. Threaded bolts extend through the brackets and connect to the bottom or side surfaces of the lamp head. Knobs or handles are usually connected to the ends of the threaded bolts which enable the bolts to be manually loosened so that the lamp head may be moved to the desired position and then manually tightened so that the lamp head is fixed at the desired position.

In order to re-adjust the position of the lamp head of the worklight on the stand, the user must use both hands. First, the lamp head must be held with one hand while the knobs or handles are manually loosened with the other hand. The lamp head is then rotated to a new position with one hand while the opposite hand re-tightens the knobs or handles. If the knobs or handles are not sufficiently tightened, gravity may cause the lamp head to rotate or fall to an undesirable resting position.

What is needed is a portable worklight mounted on a stand with a hands-free adjustable mounting system for the lamp head on the stand.

SUMMARY OF THE INVENTION

It is an object of the present invention to provide a worklight with a stand with a hands-free adjustable mounting system.

It is another object of the present invention to provide such an apparatus that enables the lamp head to be selectively aimed and then automatically held in the new position without loosening or re-tightening knobs and handles.

These and other objects of the invention are met by a hands-free mounting worklight system that includes a worklight with a lamp head designed to be adjustably mounted on a stand or pole. The stand or pole includes at least one lamp head support arm with a round inside surface and a centrally aligned hole formed on its distal end. Mounted or attached to the lamp head is an adjustable nut assembly that selectively engages the support arm so that the lamp head may be manually rotated to a desirable position on the stand or pole by merely applying rotational force to the lamp head.

The adjustable nut assembly includes a nut body with a central post. Formed on the nut body and surrounding the post is a plurality of radially aligned outward extending beveled ribs. The central post includes a threaded bore and is slightly shorter than the beveled ribs. The beveled ribs are aligned parallel to the nut's longitudinal axis and are equally spaced apart by slots. The slots on opposite sides of the nut body are transversally aligned so that an object can fit into two slots located on opposite sides of the nut body.

The support arm includes a straight portion designed to extend centrally across the adjustable nut assembly. In the preferred embodiment, the straight portion includes a round inside surface. A hole is formed in the straight portion that when aligned over the central aligned hole formed on the nut body, enables a threaded bolt to extend through the support arm and connect to the threaded bore located on the post. Disposed on the section of the bolt located inside the support arm is a spring that biases the support arm inward on the bolt and into the slots located on opposite ends of the nut body. During use, the bolt is sufficiently tightened so that when the straight portion of the support arm is extended across the nut body, the inside surface of the support arm is forced into the slots on opposite sides of the nut body. The bolt is also sufficiently loose so that the spring may be compressed to allow the support arm to move outward and slide over the beveled ribs when the head is rotated under the support arm. When the straight portion is re-aligned over the two new slots, the spring forces the sections inward into the two new slots to hold the lamp head in a new position.

DESCRIPTION OF THE PREFERRED EMBODIMENT(S)

Figure 1:
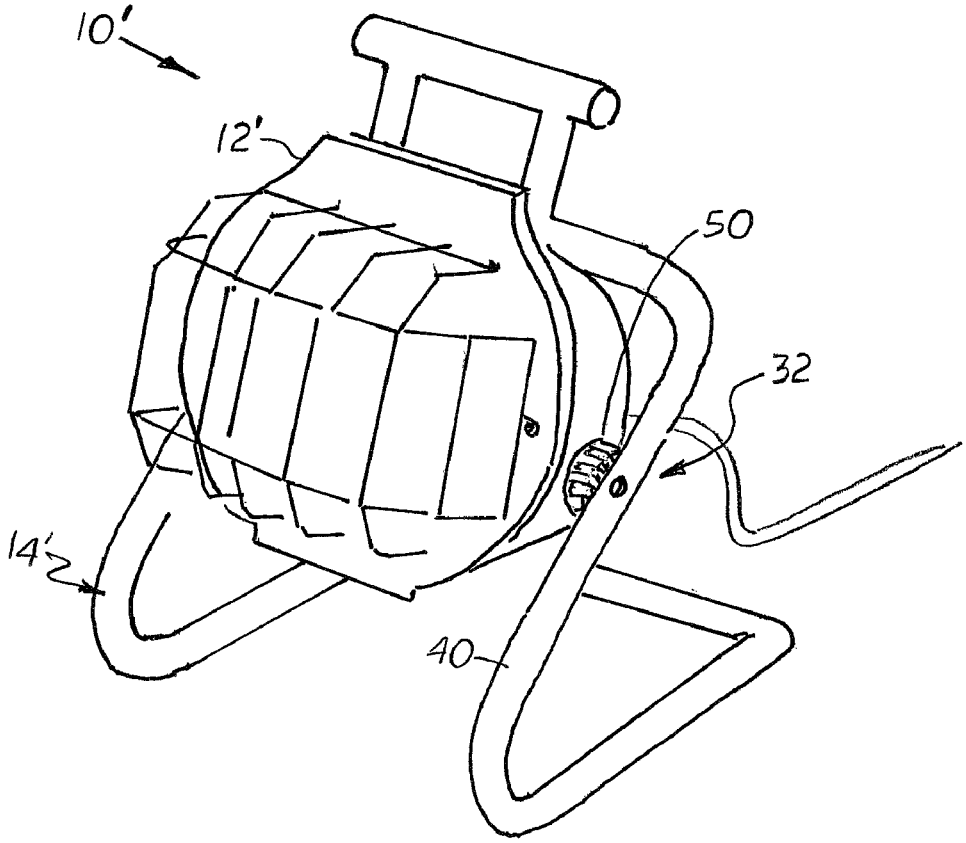
FIG. 1 is a perspective view of a portable worklight with a hands-free mounting system disclosed herein used to hold the lamp head on a floor stand.
Figure 2:
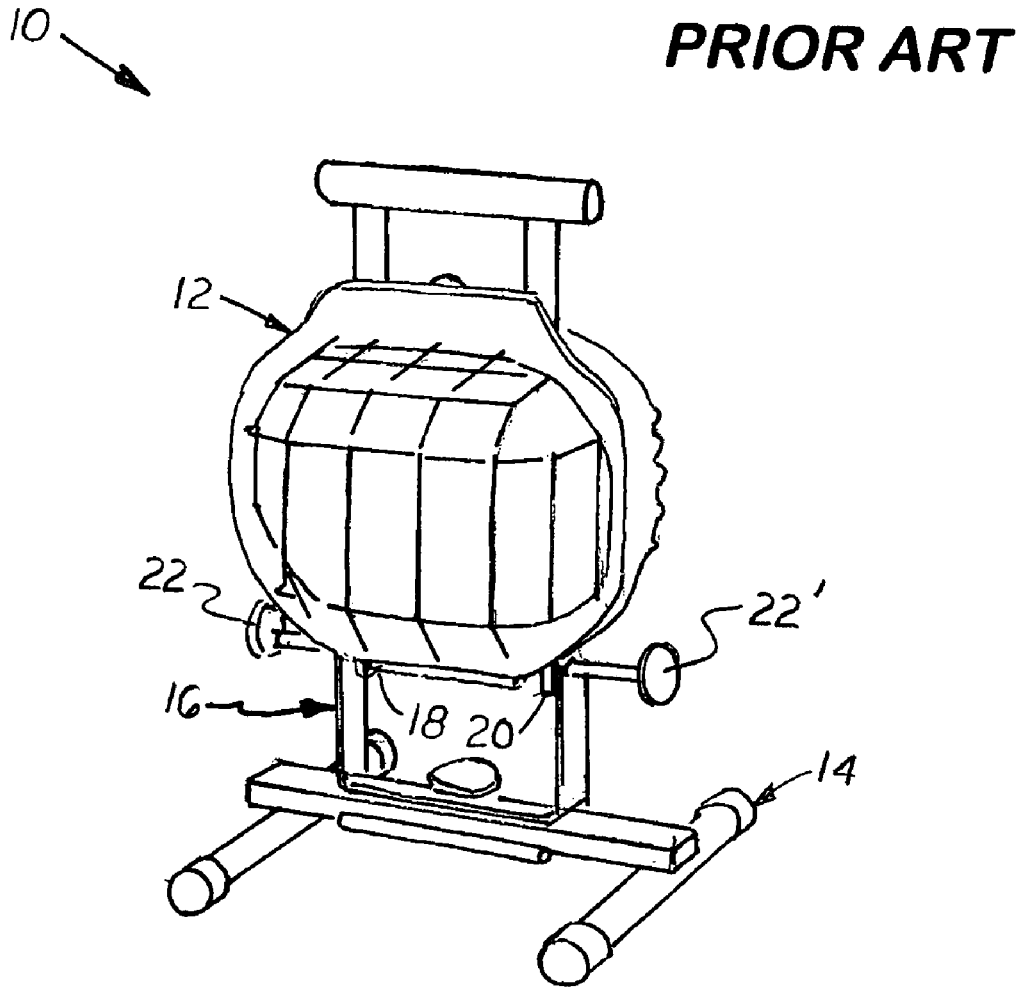
FIG. 2 is a perspective view of a portable worklight used in the prior art that uses two threaded turn knobs to attach the lamp head to a U-shaped bracket that attaches to a stand.
Figure 3:
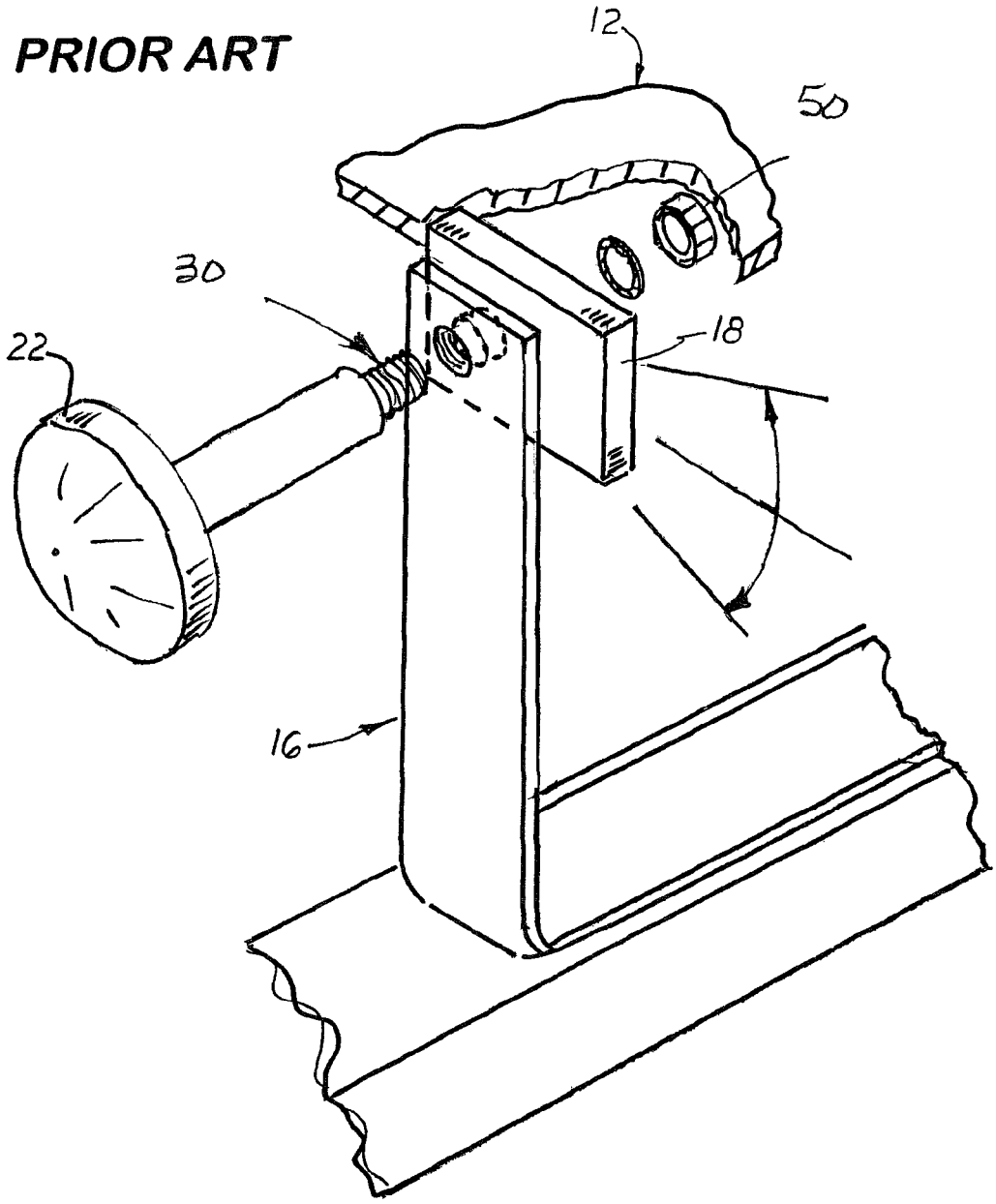
FIG. 3 is an enlarged, perspective view of the threaded turn knob and bracket used in the worklight found in the prior art.
Figure 4:
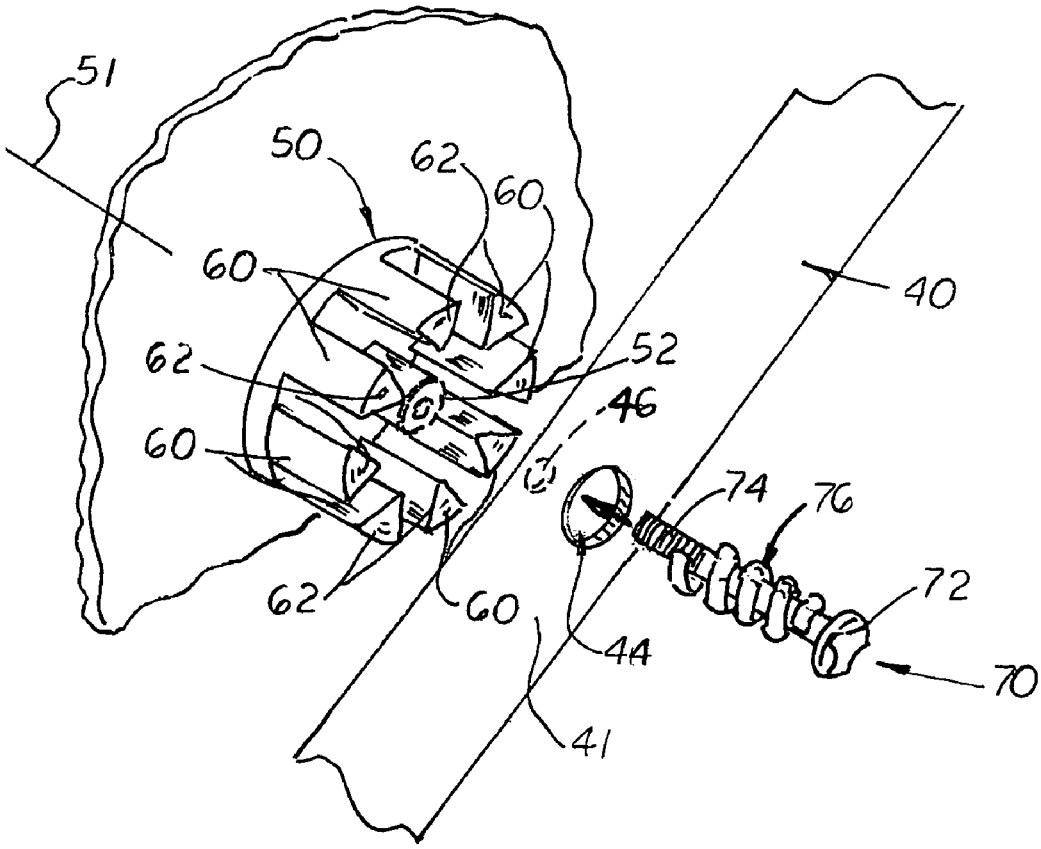
FIG. 4 is a partial, exploded perspective view of a lamp head with a nut body attached to the side of the lamp head and showing a tubular arm or support member being attached to the nut body with a threaded bolt and spring.
Figure 5:
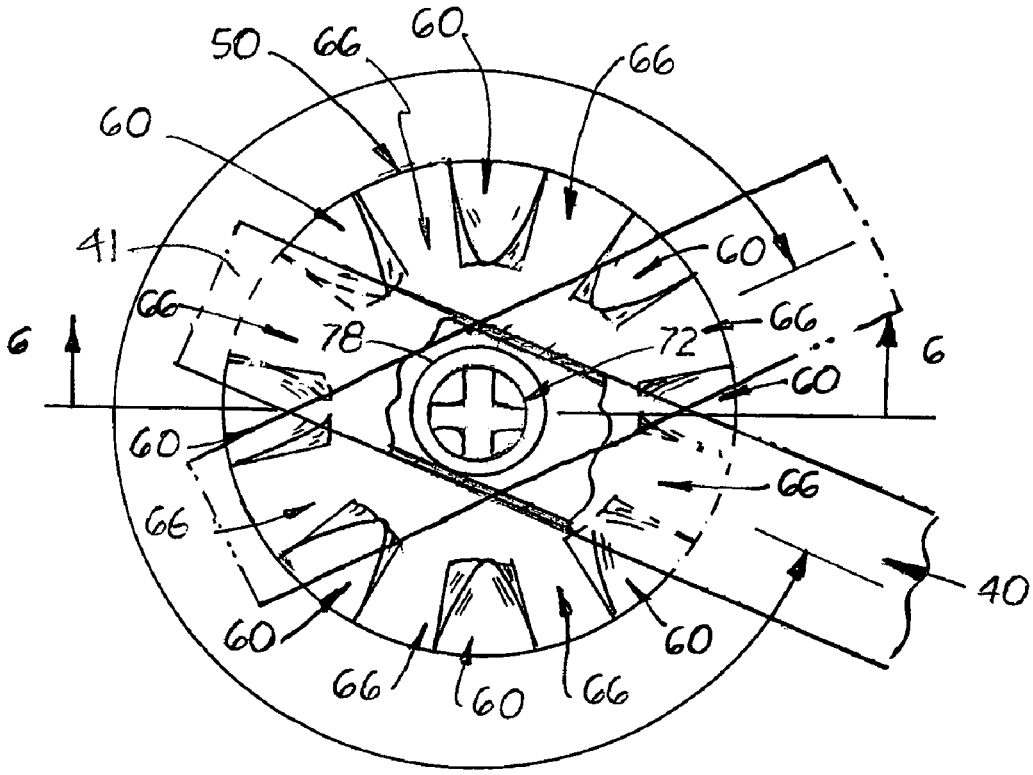
FIG. 5 is a top plan view of a tubular arm being selectively aligned over a nut body.
Figure 6:
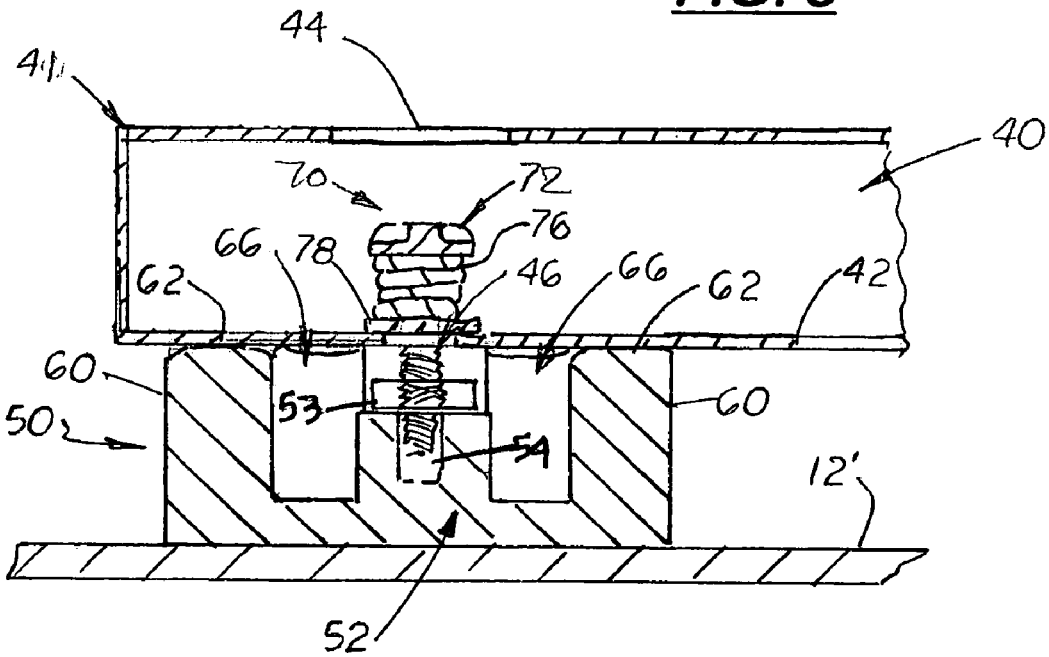
FIG. 6 is a sectional, side elevational view taken along line 6-6 in FIG. 5.

Referring to FIGS. 2 and 3, there is shown a worklight 10 found in the prior art that includes a lamp head 12 mounted on a floor supporting stand 14. A U-shaped bracket 16 is mounted on the stand 14 that connects to two tabs 18, 20 affixed to the bottom surface of the lamp head 12. Two threaded turn knobs 22, 22' extend through bores formed on the bracket 16 and the tabs 18, 20 and connect to threaded nuts 30, 30' to securely attach the bracket 16 to the two tabs 18, 20. Each time the lamp head 12 is re-adjusted on the bracket 16, the turn knobs 22, 22' must be loosened and then re-tightened. If the turn knobs 22, 22' are not sufficiently tightened, the lamp head 12 will fall forward and possibly ignite another object or surface.

FIGS. 1 and 4-6 disclose a hands-free mounting system, generally indicated by the reference number 32, designed to be used in place of the two tabs 18, 20, the standard turn knobs 22, 22' and the threaded nuts 30, 30' used in the prior art as shown in FIGS. 2 and 3. A main benefit of the system 32 is that it enables a modified lamp head 12 to be selectively aimed and then automatically held in the new position using one hand. The opposite hand is not needed to manually loosen or re-tighten any turn knobs 22, 22' or nuts 30, 30'. Because turn knobs 22, 22' and nuts 30, 30' are no longer used, errors caused by inadequately tightening the turn knobs 22, 22' and nuts 30, 30' are eliminated.

The mounting system 32 includes a modified lamp head 12' designed to be adjustably mounted on a modified stand 14'. The modified stand 14' includes at least one support arm 40 with a straight portion 41. The straight portion 41 includes a round inside surface 42 and a centrally aligned hole 44.

Formed or attached to the lamp head 12' is a laterally extending nut body 50 that enables the lamp head 12' to be manually rotated to a desirable fixed position on the stand 14' by merely applying a rotational force to the lamp head 12'. In the preferred embodiments, two nut bodies 50 are mounted on the two opposite sides of the lamp head 12'. Centrally aligned on each nut body 50 is a post 52 with a threaded nut 53 or threaded bore 54. The post 52 is surrounded by a plurality of radially aligned ribs 60. The post 52 is slightly shorter than the surrounding ribs 60. The ribs 60 are aligned parallel to the nut's longitudinally axis 51 and are equally spaced apart by a plurality of slots 66 radially aligned around the post 52. In the preferred embodiment, a pair of slots 66 are aligned on opposite sides of the post 52. The outer end 62 of each rib 60 has beveled edges.

The stand 14' includes at least one support arm 40 with a straight portion 41 that extends across the nut body 50. The inside surface 42 of the straight portion 41 is round and is sufficient in diameter so that it partially fits into two slots 66 located on opposite sides of the nut body 50. A large outer hole 44 is formed in the straight portion 41 that enables the head 72 of a threaded bolt 70 to extend through the outer hole 44. Formed inside the support arm 40 is a small inner hole 46 with a diameter smaller than the head 72. During assembly, the bolt 70 is extended through the holes 44, 46 so that the shank 74 extends through the small inner hole 46 and connects to the threaded bore 54 formed on the post 52.

The spring 76 disposed between the head 72 of the bolt 70 the washer 78 and the inside surface of the straight portion 41 which forces the support arm 40 inward and into the pair of opposite aligned slots 66 formed on the nut body 50. The spring 76 resists movement of the support arm 40 over the outer ends 62 of the ribs 60 on the nut body 50. During use, the bolt 70 is sufficiently tightened so that when the support arm 40 is extended across the nut body 50, the inner surface 42 of the support arm 40 may partially engage the two slots 66 formed on opposite sides of the nut body 50. The force of the spring 76 holds the support arm 40 in the two slots 66. The bolt 70 must be sufficiently loose so that the spring 76 may be compressed to allow the support arm 40 to move outward and slide over the outer ends 62 of the adjacent ribs 60 when the lamp head 12 is rotated on the support arm 40.

In the preferred embodiment, the lamp head 12' has two nut bodies 50 located on opposite sides of the lamp head 12'. A U-shaped bracket, similar to the U-shaped bracket 16 shown in FIG. 3, may be used with two vertical support arms 40 that engage the two nut bodies 50'. It should be understood that the lamp head 12' could be used with one nut body 50.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A worklight hands-free adjustable mounting apparatus, comprising:

a. a worklight with a lamp head adjustably mounted on a stand, said stand including at least one support arm with a straight portion, said straight portion including a centrally aligned hole formed thereon;

b. at least one adjustment nut body mounted on said lamp head, said nut body includes a centrally aligned threaded post surrounded by a plurality of radially aligned beveled ribs, said ribs being parallel and longer than said post, said ribs being spaced apart thereby forming two slots on opposite sides of said post;

c. a bolt with a threaded shank and a wide head, said shank being sufficient in diameter to slide freely through said hole formed on said straight portion of said support arm and being sufficient length to engage slots formed on opposite sides of said post; and, d. a spring disposed around said shank of said bolt and between said head, a washer and said support arm, said spring creates an inward biasing force that forces said straight portion into slots formed on opposite said slots and allows said straight portion to be selectively rotated over said ribs and engage other slots formed to change the relative position of said lamp head on said support arm.

2. The worklight as recited in claim 1, wherein said adjustment nut body is located on a vertical side of said lamp head.

3. The worklight, as recited in claim 1, wherein said lamp head includes two adjustment nuts and said stand includes two arms that are engaged to allow the worklight to be selectively adjusted.

* * * * *